US006708005B2

(12) United States Patent
Chihara

(10) Patent No.: US 6,708,005 B2
(45) Date of Patent: Mar. 16, 2004

(54) IMAGE FORMING APPARATUS AND METHOD OF CONTROLLING MEMORY THEREOF

(75) Inventor: Hiroshi Chihara, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/090,148

(22) Filed: Mar. 5, 2002

(65) Prior Publication Data

US 2002/0127021 A1 Sep. 12, 2002

(30) Foreign Application Priority Data

Mar. 9, 2001 (JP) ..... 2001-067219

(51) Int. Cl.[7] ..... G03G 15/00
(52) U.S. Cl. ..... 399/12; 399/24
(58) Field of Search ..... 399/8, 12, 13, 399/24, 25, 26, 27, 31

(56) References Cited

U.S. PATENT DOCUMENTS 4,961,088 A 10/1990 Gilliland et al.
5,491,540 A * 2/1996 Hirst ..... 399/12
5,579,088 A 11/1996 Ko
5,835,817 A 11/1998 Bullock et al. ..... 399/25
5,930,553 A * 7/1999 Hirst et al. ..... 399/12 X
5,995,774 A 11/1999 Applegate et al. ..... 399/27
6,144,812 A * 11/2000 Ueno ..... 399/12
6,498,905 B1 * 12/2002 Tsuruya ..... 399/12

FOREIGN PATENT DOCUMENTS

JP 11-338329 12/1999

* cited by examiner

*Primary Examiner*—William J. Royer
(74) *Attorney, Agent, or Firm*—Fitzpatrick, Cella, Harper & Scinto

(57) ABSTRACT

Information including a NewCartridgeBit indicating that a cartridge having an internal non-volatile memory is a new (unused) cartridge and information including a FirstInstallDate related to the NewCartridgeBit and the date of indicating first use of the cartridge have been recorded in the non-volatile memory of the cartridge. If an update command for updating the NewCartridgeBit has been issued, the NewCartridgeBit is updated and then the FirstInstallDate is updated if the FirstInstallDate is an initial value. If an update command for updating the FirstInstallDate has been issued, then, when the NewCartridgeBit is not an initial value, the FirstInstallDate is updated if it is the initial value. As a result, the conformity between the interrelated information the NewCartridgeBit and the FirstInstallDate can be maintained.

15 Claims, 5 Drawing Sheets

IMAGE FORMING APPARATUS AND METHOD OF CONTROLLING MEMORY THEREOF

FIELD OF THE INVENTION

This invention relates to an image forming apparatus into which a cartridge having a built-in memory is inserted, and to a method of controlling the memory.

BACKGROUND OF THE INVENTION

An image forming apparatus known in the art employs a non-volatile memory mounted on a replaceable unit for the purpose of improving the image quality of a copier or printer, or other device, and in order to perform accurate management of the lifetime of the replaceable unit. In an image forming apparatus of this kind, the connection between the non-volatile memory of the replaceable unit and the apparatus proper is achieved by a connector. However, since the signal to the non-volatile memory is very weak, a malfunction can occur even if there is only a slight imperfection in electrical contact within the connector.

Accordingly, in an effort to avoid faulty contact in the connector, an image forming apparatus in which a main body of the apparatus proper and the non-volatile memory are coupled electromagnetically has been proposed in the specification of Japanese Patent Application Laid-Open No. 11-338329.

More specifically, in a printer that employs an electrophotographic process, for example, a process cartridge (replaceable unit), which is obtained by integrating a photosensitive drum, a developing device and a toner accommodating compartment, or other device, is removably installed in the printer and is equipped with a non-contact IC memory unit for recording such information as the history of use and the process conditions, or other data.

In a case where information is recorded in the IC memory unit or information in the IC memory unit is updated, specified information is merely recorded in a designated memory area and, as a consequence, there is the possibility that items of related data will no longer be in conformity with each other. Accordingly, the IC memory unit is so arranged that items of data that are interrelated are rewritten automatically when information serving as the reference is recorded. Among these items of interrelated information, the information serving as the reference is referred to as higher-order information and the information that is rewritten in association with the higher-order information is referred to as lower-order information.

Consider a case where information (denoted by "NewCartridgeBit" below) indicating a cartridge that is brand new and information (denoted by "FirstInstallDate" below) indicating first date of use is registered in the IC memory unit. In this instance, the former is higher-order information and the latter is lower-order information. If the cartridge is a new cartridge, a NewCartridgeBit is set in the mounted IC memory unit and a date serving merely as an initial value is recorded as the FirstInstallDate.

If printing is executed upon installing the new cartridge in the printer, the NewCartridgeBit constituting the higher-order information is reset and, in association therewith, the date of print execution is recorded as the FirstInstallDate, which is the lower-order information. However, a printer control unit within the printer does not possess data indicative of the current date. In actuality, therefore, the FirstInstallDate is recorded in response to receipt of current-date data possessed by a controller that has been connected to the printer or by an external host computer that has been connected to the printer via this controller.

However, in a conventional printer in which the cartridge having the built-in memory is installed, the items of information that have been recorded in the memory of the cartridge will not necessarily be in harmony with each other.

For example, the above-mentioned printer often possesses a test-print function that enables the printing function to be checked in the development stage of the printer without connecting a controller that assists in data communication with, e.g., an external host computer.

When test printing is performed in the above-mentioned conventional printer, a new (unused) cartridge is installed in the printer. However, because a controller or host computer has not been connected to the printer, data indicative of the current date cannot be acquired in the printer control unit and, as a consequence, the FirstInstallDate cannot be recorded in the IC memory unit of the cartridge, and the NewCartridgeBit is merely reset.

The problem that arises in this case is that even if a controller is connected and printing is performed after the test print, the fact that the NewCartridgeBit will already have been reset means that nothing will be recorded for the FirstInstallDate, which is the lower-order information updated in association with the NewCartridgeBit.

Thus, if only the higher-order information of interrelated information within the IC memory unit of the above-described conventional printer is updated or if the lower-order information is not capable of being updated for some reason, then it will not be possible to subsequently update only the related lower-order information. Thus, the problem arises that the information that is recorded in the memory unit will be defective.

SUMMARY OF THE INVENTION

Accordingly, an object of the present invention is to provide an image forming apparatus, in which a cartridge with a built-in memory is installed, and a method of controlling the memory, wherein the apparatus is capable of maintaining the conformity between mutually related information that has been recorded in the memory within the cartridge.

In order to attain the above-described objects, an image forming apparatus of the present invention comprises a structure as follows.

An image forming apparatus from which a unit having a non-volatile memory for storing first and second information can be removed, comprises: update designation means for designating the updating of information stored in the non-volatile memory; and update means for updating the information, which has been recorded in the non-volatile memory, based upon a designation by the update designation means; wherein the update means updates the second information after the completion of updating of the first information in a case where the designation is to update the first information, and the update means updates the second information if the second information is a predetermined value, in a case where the designation is to update the second information.

In order to attain the above-described objects, a memory control method of the present invention comprises the steps as follows.

A memory control method in an image forming apparatus from which a unit having a non-volatile memory for storing first and second information can be removed, comprises: an update designation step of designating the updating of information stored in the nonvolatile memory; a first update step of updating the second information after a completion of updating of the first information in a case where it is designated to update the first information at the update designation step; and a second update step of updating the second information if the second information is a predetermined value, in a case where it is designated to update the second information at the update designation step.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate an embodiment of the invention and, together with the description, serve to explain the principles of the invention.

DESCRIPTION OF THE PREFERRED EMBODIMENTS

Preferred embodiments of the present invention will now be described in detail with reference to the drawings.

First Embodiment

[Structure of Apparatus]

Described first will be the structure of an electrophotographic printer (referred to simply as a "printer" below), which is one example of an image forming apparatus to which this embodiment is applied. The printer according to this embodiment is so adapted as to enable removable installation (replacement) of a process cartridge obtained by integrating a photosensitive drum, a developing device and a toner accommodating compartment, and/or other devices. The process cartridge is equipped with a non-contact IC memory unit for recording such information as the history of use and the process conditions, and/or other data.

Figure 1:
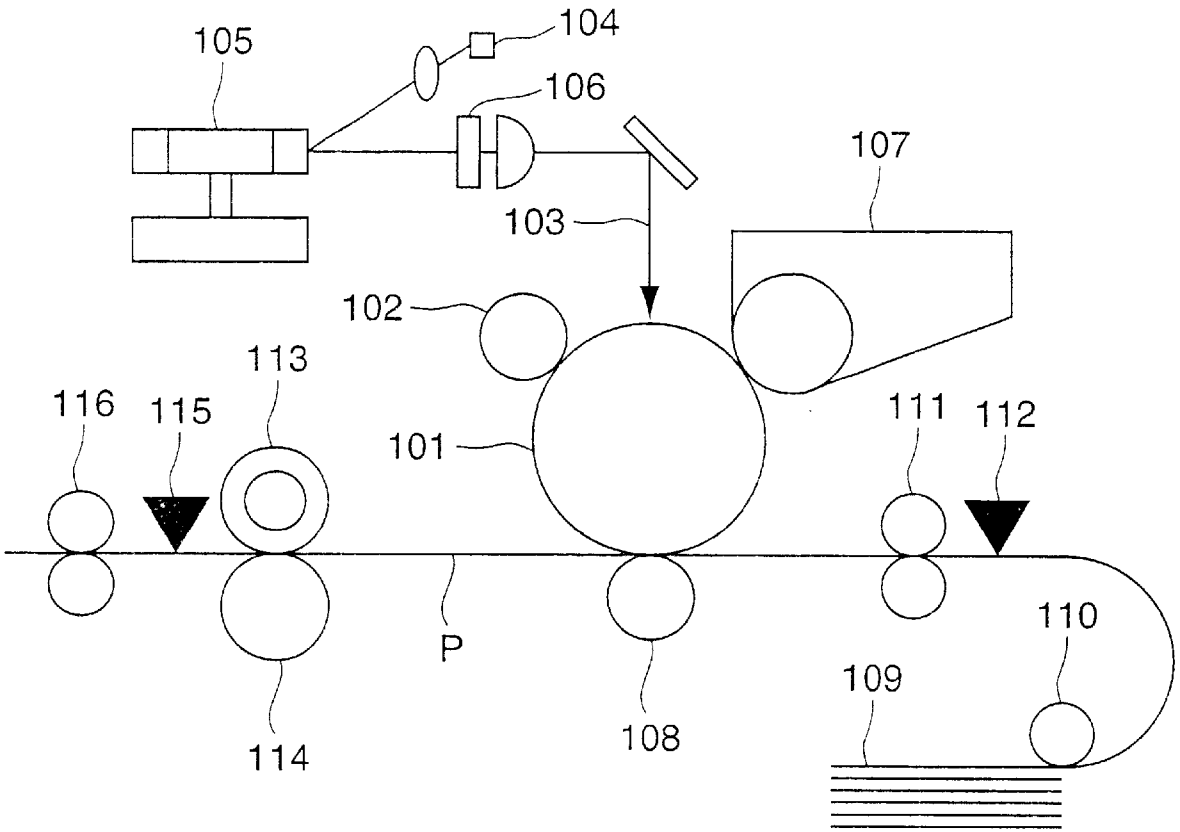
FIG. 1 is a diagram showing a schematic representation of a printer according to a first embodiment of the present invention.

FIG. 1 is a diagram useful in describing the general structure of the printer according to this embodiment.

As shown in FIG. 1, the printer includes a photosensitive drum 101 serving as a carrier for an electrostatic latent image. A charging roller 102 for uniformly charging the surface of the photosensitive drum 101 is provided above the photosensitive drum 101 in contact with the surface thereof. The charged surface of the photosensitive drum 101 downstream from the point of contact with the charging roller 102 in the direction of rotation is irradiated with a light beam 103 by light generating means. The light generating means includes a semiconductor laser 104 for emitting the light beam 103, a scanner 105 that causes the light beam 103 to scan the surface of the photosensitive drum 101, and an optical lens 106 for adjusting the light beam 103 so as to form a spot on the surface of the photosensitive drum 101. An electrostatic latent image is formed on the surface of the photosensitive drum 101 owing to irradiation with the light beam 103 based upon the image data.

The electrostatic latent image is developed as a toner image on the photosensitive drum 101 by a developing unit 107 disposed so as to contact the photosensitive drum 101 at a point farther downstream, in the direction of rotation, of the point irradiated by the light beam 103. The toner image is transferred to paper P, which serves as a transfer medium, by a transfer roller 108 disposed below the photosensitive drum 101 so as to oppose the same. Though the paper P is accommodated in a paper cassette 109 disposed in front of the photosensitive drum 101 (on the right-hand side of the photosensitive drum 101 in FIG. 1), the paper P can be fed manually if desired. A paper-feed roller 110 is disposed at the end of the paper cassette 109 and rotates to feed the paper P from the interior of the paper cassette 109 to a transport path. Disposed in the transport path between the paper-feed roller 110 and the transfer roller 108 is a registration roller 111 for correcting skew of the paper P and synchronizing formation of the image on the photosensitive drum 101 and transport of the paper P. Thus the paper P is fed to the above-mentioned transfer point at a predetermined timing. A paper-presence sensor 112 is disposed between the registration roller 111 and paper-feed roller 110 and is adapted to sense the absence or presence of the paper P.

The paper P to which the unfixed toner image has thus been transferred is transported to a fixing device in back of the photosensitive drum 101 (on the left-hand side of the photosensitive drum 101 in FIG. 1). The fixing device comprises a fixing roller 113 having an internal fixing heater (not shown), and a pressurizing roller 114 placed so as to come into pressured contact with the fixing roller 113. The paper P transported from the transfer point is heated while being subjected to pressure at the pressurizing point between the fixing roller 113 and pressurizing roller 114, whereby the unfixed toner image on the paper P is fixed to the paper P. A paper ejection sensor 115 for checking that the paper P has been ejected from the pressurizing point is disposed in back of the pressurizing point. Ejection rollers 116 are provided in back of the paper ejection sensor 115 and eject, to the exterior of the machine, the printed paper P to which the toner image has been fixed.

Figure 2:
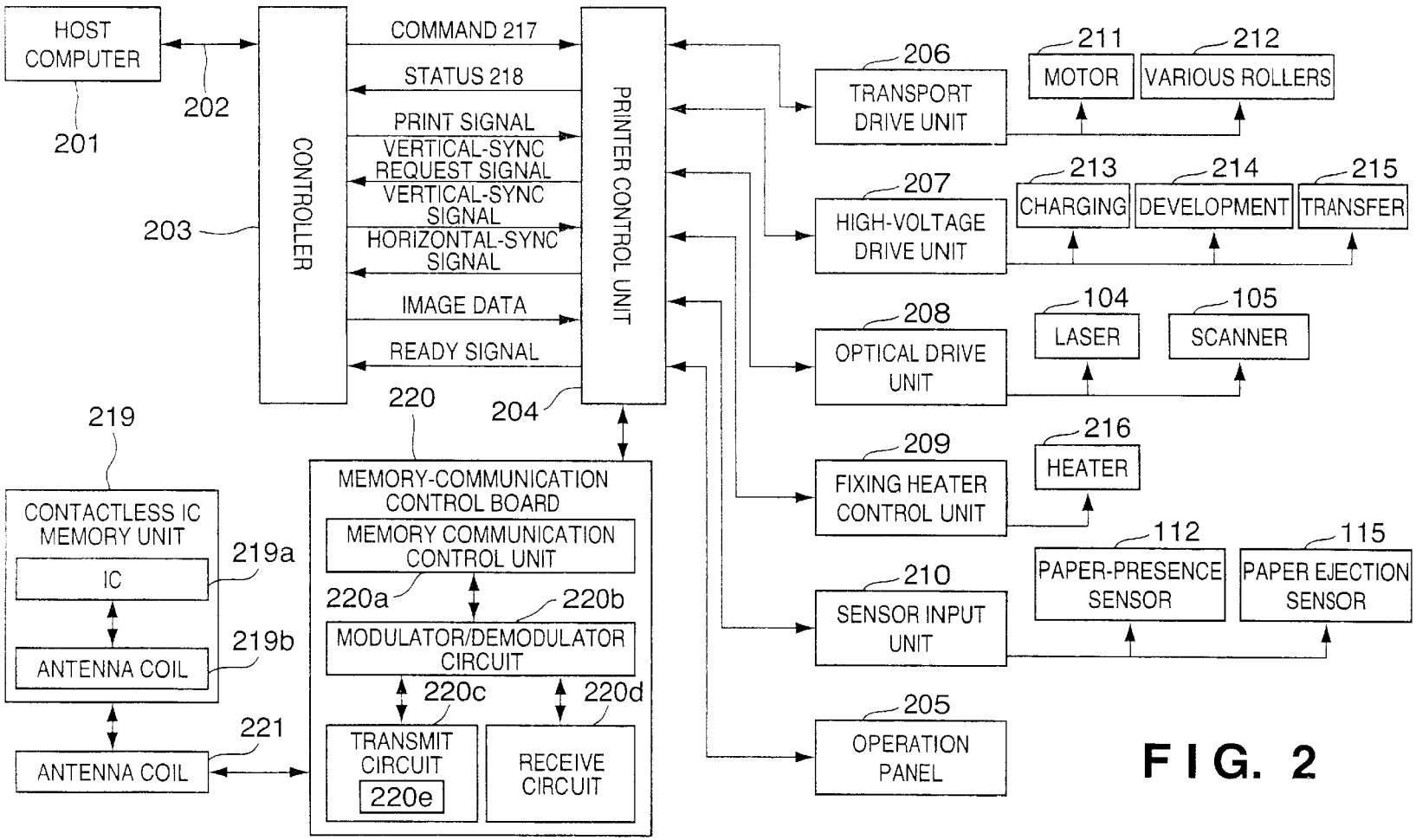
FIG. 2 is a block diagram of the printer according to this embodiment.

Reference will now be had to the block diagram of FIG. 2 to describe the structure of the electrophotographic printer having the mechanism illustrated in FIG. 1.

As shown in FIG. 2, a host computer 201, which is disposed externally of the electrophotographic printer, sends parallel or serial image code data that has been created by a user operation to a controller 203 via a communication line 202.

The controller 203 expands the image code data sent from the host computer 201, converts the data to image information to be sent to the printer, issues a command to a printer control unit 204, reads internal data from the printer control unit 204 as status data and sends the printer control unit 204 a print start request and a preliminary paper-feed request. Further, an operation panel 205 that allows the user to set the printer to various modes (and to set the margin of an image area, and/or other parameters) is connected to the printer control unit 204.

It should be noted that the controller 203 may reside within the printer or within the host computer 201.

In order to control the timing for starting and stopping each component in the mechanism shown in FIG. 1 and in order to read input information from each of the sensors, the printer control unit 204 is connected to a transport drive unit 206, a high-voltage drive unit 207, an optical drive unit 208, a fixing heater control unit 209, and a sensor input unit 210. Each of these drive units will now be described.

On the basis of commands from the printer control unit 204, the transport drive unit 206 drives and halts motor 211 and various rollers 212 and the high-voltage drive unit 207 drives and halts the charging unit 213, the development unit 214, and the transfer unit 215.

On the basis of commands from the printer control unit 204, the optical drive unit 208 drives and halts the laser 104 and scanner 105 and the fixing heater control unit 209 drives and halts the fixing heater 216.

The sensor input unit 210 reads information from the paper-presence sensor 112 and the paper ejection sensor 115 and supplies this information to the printer control unit 204.

The control operation in the printer having the structure set forth above will now be described.

First, the printer attains a state in which it awaits a print signal from the controller 203.

If a print signal has not yet been received, the printer determines whether a preliminary paper-feed request has been issued by the controller 203. If such a request has been received, then the motor 211 is driven into operation and paper feed is started. The printer then checks to see whether the paper P has arrived at the position of the paper-presence sensor 112. When the leading edge of the paper P is sensed by the paper-presence sensor 112, the printer halts the paper-feed operation upon elapse of a predetermined period of time. At this moment the motor 211 is stopped and the printer waits for a print signal.

If a print signal is received from the controller 203, the printer starts up the scanner 105 and the high voltage system when the motor 211 is driven into operation again. When the scanner motor (not shown) reaches a stipulated rotation, the paper-presence sensor 112 checks for the absence/presence of the paper P because the paper P has already been fed preliminarily. If the paper P is not present at the paper-presence sensor 112 at this time, processing (jam processing, and/or other processing) for dealing with an abnormal situation is executed. If the paper-presence sensor 112 senses the presence of the paper P, a vertical-synchronization request signal is output to the controller 203.

Upon receiving the vertical-synchronization request signal, the controller 203 supplies a vertical synchronization signal to the printer control unit 204. When the printer control unit 204 receives the vertical synchronization signal, the printer control unit 204 enables writing of an image onto the photosensitive drum 101 and drives the registration roller 111 into rotation. Upon the elapse of a predetermined period of time from detection of the trailing edge of the paper P by the paper ejection sensor 115, the operation of the high-voltage drive unit 207 and the scanner motor is stopped and the rotation of the motors in the roller drive system is halted, thereby terminating print processing.

In the electrophotographic printer described here, use is made of a process cartridge, which is obtained by integrating the photosensitive drum 101, the developing unit 107 and the toner compartment shown in FIG. 1. The process cartridge is capable of being removably installed in the printer proper. Furthermore, the process cartridge is equipped with a non-contact IC memory unit 219 shown in FIG. 2. By storing print condition data such as the number of sheets printed and the length of current application time in the IC memory unit 219, the optimum process conditions (high-voltage conditions, and/or other conditions) can be found for every print job.

The electrophotographic printer is equipped with a memory-communication control board 220 for communication with the non-contact IC memory unit 219. The memory communication control board 220 has a memory communication control unit 220*a*, a modulator/demodulator circuit 220*b*, a transmit circuit 220*c* and a receive circuit 220*d*. The transmit circuit 220*c* includes a resonance circuit 220*e*.

The modulator/demodulator circuit 220*b* is connected to an antenna coil 221 via the transmit circuit 220*c* and the receive circuit 220*d*, the modulator/demodulator circuit 220*b* is connected to the memory communication control unit 220*a*, and the memory communication control unit 220*a* is connected to the printer control unit 204. The sending and receiving of data between the printer control unit 204 and non-contact IC memory unit 219 is performed over the above path.

The non-contact IC memory unit 219 has an IC 219*a* and an antenna coil 219*b* for producing electromagnetic induction. As a result of electromagnetic induction produced by the antenna coil 219*b*, the IC 219*a* acquires electric power and communication data from the printer proper that is sent and received via the memory-communication control board 220.

The IC 219*a* incorporates a demodulator circuit for demodulating modulated data at the time of data reception and a modulator circuit for modulating demodulated data and sending the modulated data to the antenna coil 219*b* at the time of data transmission. These circuits make it possible to send and receive data to and from the printer proper.

The printer control unit 204 communicates with the memory communication control unit 220*a* on the memory communication control board 220 using the serial communication function of a microcontroller.

An example of information recorded in the non-contact IC memory unit 219 mounted in the process cartridge is information indicating the number of sheets printed, the length of current application time, the first date of use and whether the cartridge is a new cartridge, information indicating the status of use of the printer such as the amount of remaining toner, a warning of little remaining toner, and a warning of toner depletion, and information indicating printing process conditions such as the sensitivity of the photosensitive drum and a timing threshold value for changing over the value of a charging current. Furthermore, the non-contact IC memory unit 219 has a non-volatile memory. When the power supply of the printer proper is turned off, therefore, the contents recorded in the memory will be preserved for use the next time the power supply is turned on.

[Updating of Data in Non-contact IC Memory Unit 219]

In a case where information of interest is to be recorded or updated in the non-contact IC memory unit 219, there is the possibility that interrelated items of data will no longer be in conformity with each other if specified information is merely recorded in a designated memory area. This can lead to certain contradictions. For example, information indicating that the cartridge is a new cartridge may be set despite the e fact that the number of printing sheets is not "0", or the date of last use may be earlier than the date of first use.

In order to avoid these contradictions, the interrelated items of information are updated automatically when reference information is recorded. Among these items of interrelated information, the reference information is referred to as higher-order information and the information that is updated in association with the higher-order information is referred to as lower-order information.

Consider a case where information (denoted by "NewCartridgeBit" below) indicating a cartridge that is brand new (unused) and information (denoted by "FirstInstallDate" below) indicating first date of use of the cartridge is registered in the IC memory unit 219. In this instance the higher-order information is the NewCartridgeBit and the lower-order information is the FirstInstallDate. If the cartridge is a new cartridge, the NewCartridgeBit will have been placed in the set state in the mounted IC memory unit 219 and a date serving merely as an initial value will have been recorded as the FirstInstallDate.

If printing is executed upon installing the new cartridge in the printer, the state of the NewCartridgeBit is reset and the date of print execution should be recorded as the FirstInstallDate. The printer control unit 204, however, does not possess date data. Here the printer control unit 204 can record the FirstInstallDate by accepting date data, which is possessed by the controller 203 or host computer 201, via communication between the controller 203 and the printer control unit 204.

However, as pointed out in the example of the prior art described earlier, the printer of this embodiment also is equipped with a test-print function that enables the printing function to be checked even in a state in which the controller 203 is not connected. Accordingly, if a new cartridge is installed and test printing is carried out, the fact that the controller 203 and host computer 201 have not been connected to the printer means that the FirstInstallDate cannot be recorded in the non-contact IC memory unit 219 and only the NewCartridgeBit is placed in the reset state.

Accordingly, in this embodiment when printing is performed upon connecting the controller 203 following a test printing, the FirstInstallDate, which is the lower-order information, is recorded independently in suitable fashion, in a case where the NewCartridgeBit, which is the higher-order information, has already been reset. Control for updating related information within the non-contact IC memory unit 219 according to this embodiment will now be described.

In the example described below, the NewCartridgeBit serving as the higher-order information and the FirstInstallDate serving as the lower-order information will be the items of interrelated information recorded in the non-contact IC memory unit 219. That is, it is assumed that the NewCartridgeBit has been placed in the set state in the non-volatile memory within the non-contact IC memory unit 219 mounted in a new cartridge and that date information serving a simple initial value has been recorded as the FirstInstallDate in the non-volatile memory.

This embodiment is characterized in that the initial value of the FirstInstallDate serving as the lower-order information is not made "0" but is made a value (a predetermined date or null (0) which must not be set) that cannot possibly be set during usage of the image forming apparatus because it is possible to be written as "0" when an error (e.g., the memory writing operation is halted due to power OFF) or during writing data into the IC memory unit.

[Higher-order Information Update Processing (Relationship Update Processing)]

Figure 3:
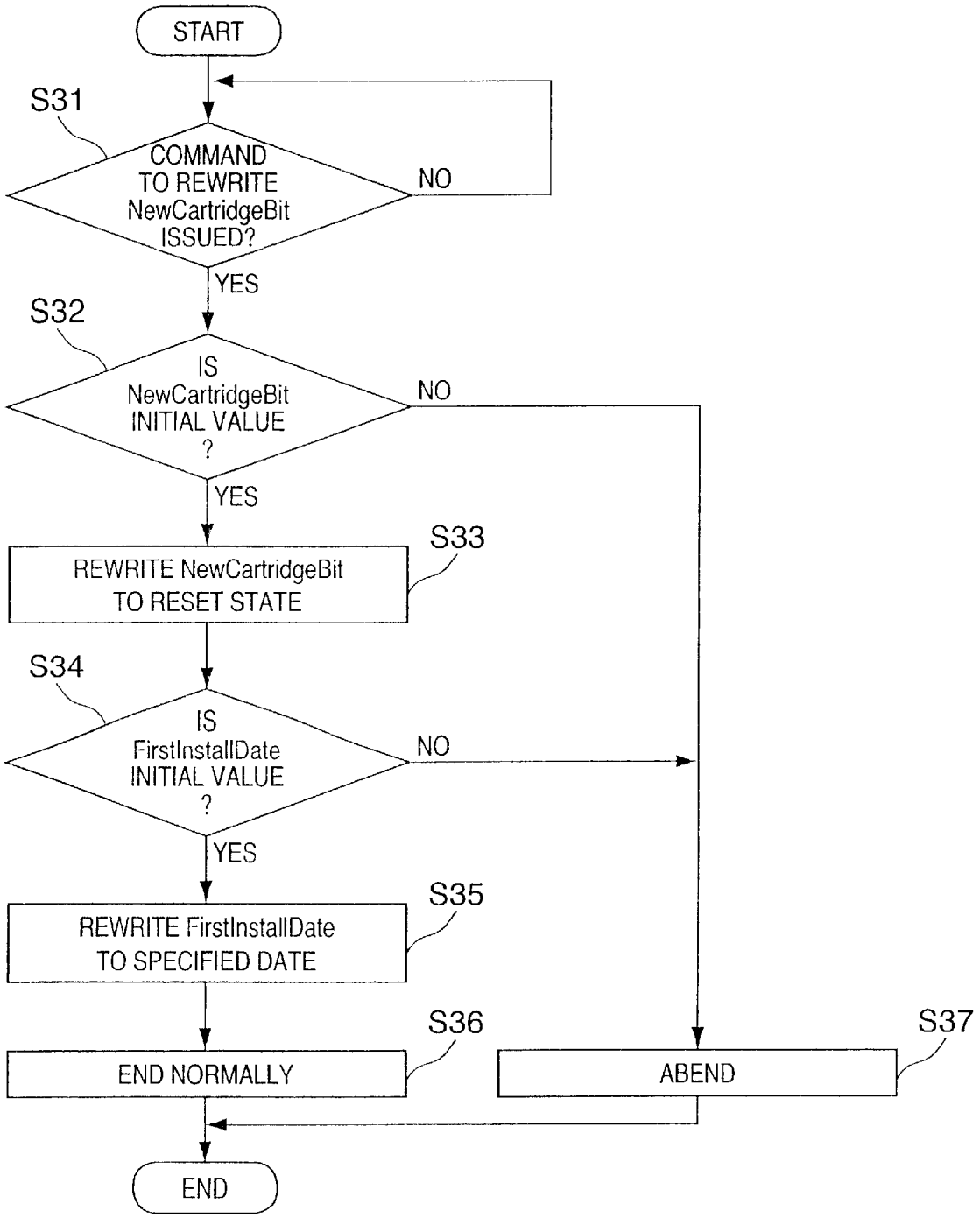
FIG. 3 is a flowchart illustrating processing for updating higher-order information according to this embodiment.

First, reference will be had to the flowchart of FIG. 3 to describe processing for associating and updating related information within the non-contact IC memory unit 219, namely processing for a case where a command to rewrite the higher-order information has been received.

If a command to rewrite related higher-order information (NewCartridgeBit) has been received by the memory communication control unit 220*a* from the printer control unit 204 at step S31, control proceeds to step S32. Here the memory communication control unit 220*a* first determines whether the NewCartridgeBit is an initial value (in this case the set state "1"). If the bit is not the initial value, control proceeds to step S37 without a rewrite being executed. Here error processing is executed and the process ends. On the other hand, if it is found at step S32 that the NewCartridgeBit is the initial value "1", control proceeds to step S33, where the NewCartridgeBit is reset (to state "0"). Then, at step S34, it is determined whether the FirstInstallDate is the initial value (a predetermined date or null which must not be set). If it is found that the FirstInstallDate is not the initial value, control proceeds to step S37, where a rewrite error is sent back. If the FirstInstallDate is the initial value, however, then control proceeds to step S35. Here time information given by the rewrite command is written as the FirstInstallDate. The operation is then ended normally (step S36).

Thus, the rewriting of the NewCartridgeBit, which is the higher-order information, is accompanied also by the rewriting of the FirstInstallDate serving as the lower-order information.

[Lower-order Information Update Processing]

Figure 4:
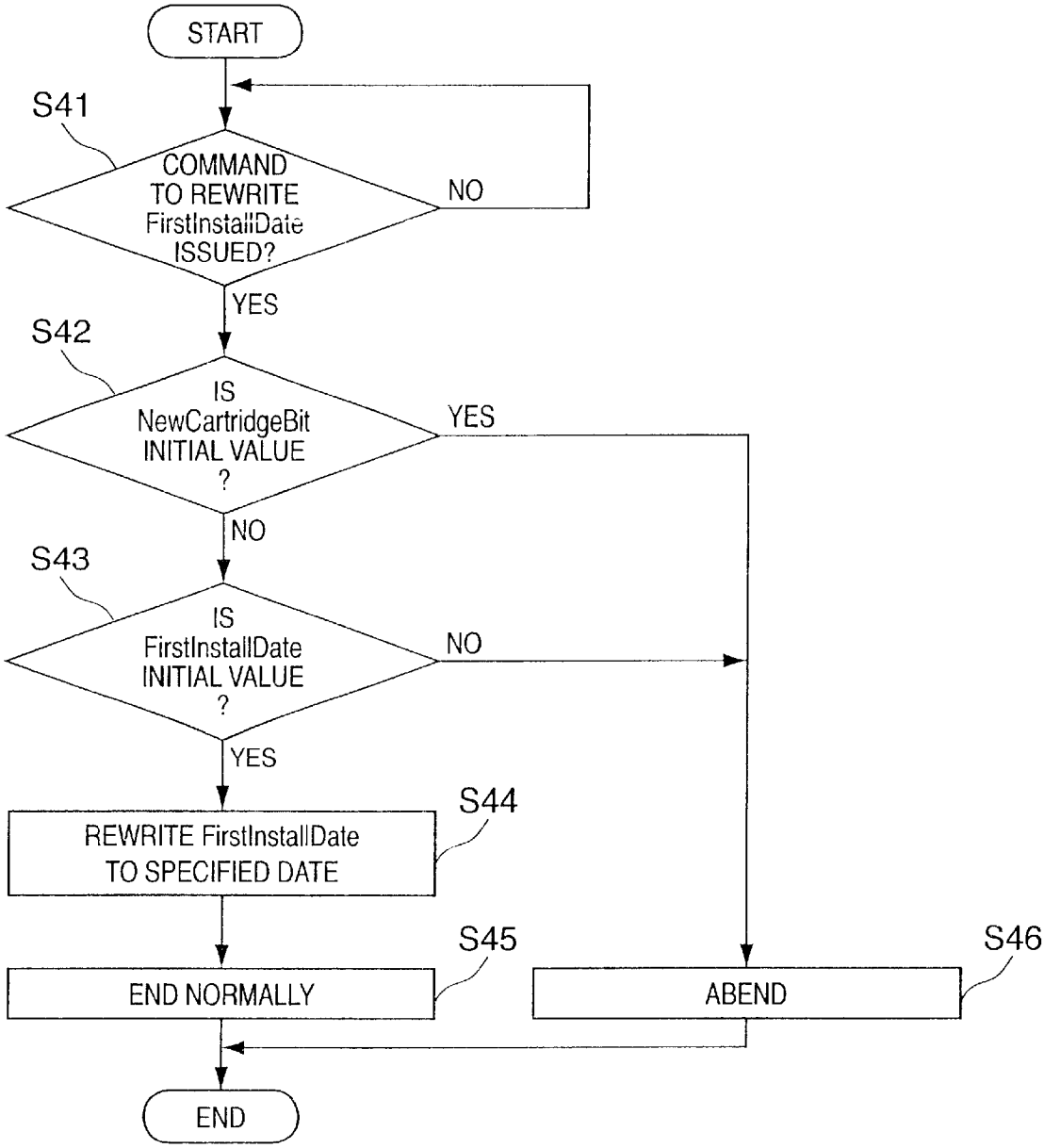
FIG. 4 is a flowchart illustrating processing for updating lower-order information according to this embodiment.

Reference will be had to the flowchart of FIG. 4 to describe the characterizing feature of this embodiment, namely processing for updating the lower-order information, i.e., processing for a case where a command to rewrite the lower-order information has been received.

If a command to rewrite the FirstInstallDate, which is the lower-order information, has been received by the memory communication control unit 220*a* from the printer control unit 204 at step S41, the control proceeds to step S42. Here the memory communication control unit 220*a* first determines whether the NewCartridgeBit, which is the related higher-order information, is an initial value (i.e., whether it is in the set state). If the bit is not the initial value, control proceeds to step S43, where it is determined whether the FirstInstallDate serving as the lower-order information is the initial value. If it is found at step S43 that the FirstInstallDate is the initial value, then control proceeds to step S44. Here the specified date information is written to the memory and processing is ended normally (S45). On the other hand, if it is found at step S43 that the FirstInstallDate is not the initial value, then it is construed that a rewrite has already been performed and, hence, control proceeds to step S46. Here processing abends without a rewrite command being received. Further, if it is found at step S42 that the NewCartridgeBit serving as the higher-order information is the initial value, control proceeds to step S46. Since it would be unnatural for a rewrite command to be generated solely with respect to the FirstInstallDate, which is the lower-order information, processing abends without such a command being received.

In accordance with the first embodiment, as described above, it is possible to update only the lower-order information of items of interrelated information, which have been recorded in the non-contact IC memory unit 219, based upon control exercised by the memory communication control unit 220*a*. As a result, it is possible to maintain the conformity between items of interrelated information.

Further, a value that cannot be taken on in ordinary processing is adopted as the initial value of the lower-order information. As a result, if an error of some kind occurs, not only in the lower-order information, but also in the content of the related higher-order information, this can be detected in highly precise fashion.

Second Embodiment

A second embodiment of the present invention will now be described.

As the structure and operation of the printer in the second embodiment are similar to those of the first embodiment set forth above, these need not be described again. In the second embodiment, also a value that cannot be taken on in ordinary processing is adopted as the initial value of lower-order information recorded in the non-contact IC memory unit 219, and processing for updating related information, i.e., the operation in response to the command to rewrite the NewCartridgeBit serving as the higher-order information, is similar to that illustrated in the flowchart of FIG. 5 in the first embodiment.

[Lower-order Information Update Processing]

Figure 5:
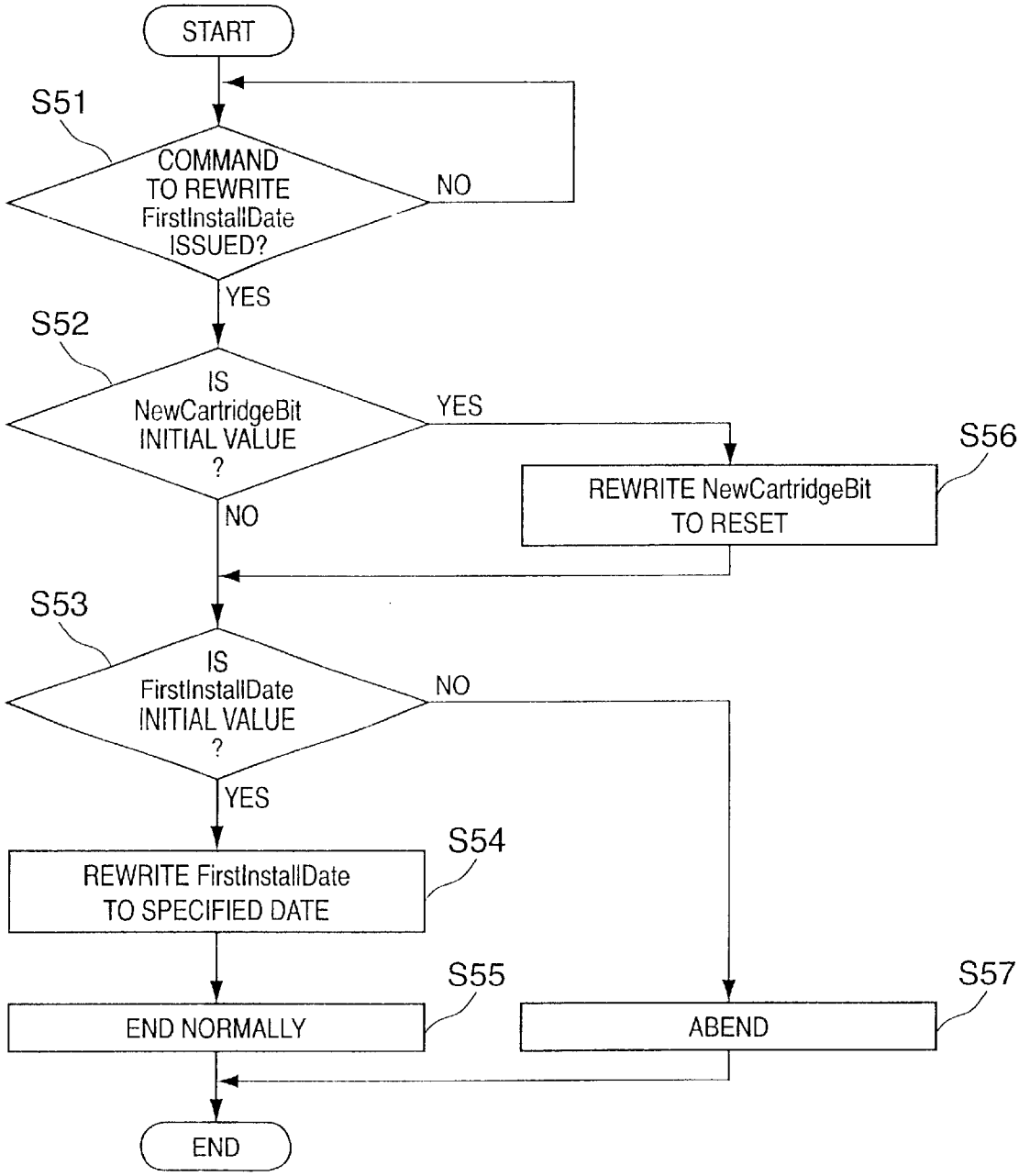
FIG. 5 is a flowchart illustrating processing for updating lower-order information according to a second embodiment of the present invention.

FIG. 5 is a flowchart illustrating processing according to a second embodiment in a case where a command to rewrite lower-order information has been received.

If a command to rewrite the FirstInstallDate, which is the lower-order information, has been received from the printer control unit 204 at step S51, the memory communication control unit 220*a* determines whether the NewCartridgeBit, which is the related higher-order information, is an initial value (the set state "1") at step S52. If the NewCartridgeBit is not the initial value, control proceeds to step S53, where it is determined whether the FirstInstallDate is the initial value. If it is found at step S53 that the FirstInstallDate is the initial value, then control proceeds to step S54. Here the specified date information is written to memory and processing is ended normally (step S55). On the other hand, if it is found at step S53 that the FirstInstallDate is not the initial value, then it is construed that a rewrite has already been performed and, hence, processing abends without a rewrite command being received (S57).

If it is found at step S52 that the NewCartridgeBit serving as the higher-order information is the initial value, control proceeds to step S56. Here the NewCartridgeBit is rewritten to the reset value "0" after which control proceeds to step S53, where it is determined whether the FirstInstallDate serving as the lower-order information is the initial value. Thereafter, in the manner described above, the specified time information is written to the memory and processing ends normally (S54, S55) if the FirstInstallDate is the initial value, or processing abends (S57) if the FirstInstallDate is not the initial value.

In accordance with the second embodiment, as described above, if an update command is issued solely with regard to lower-order information of items of interrelated information that have been recorded in the non-contact IC memory unit 219, even the related higher order information can be updated as necessary. As a result, it is possible to maintain the conformity between items of interrelated information to an even greater extent than in the first embodiment.

[Other Embodiment]

In the first and second embodiments, an arrangement in which the printer control unit 204 and the memory-communication control board 220 are in dependent of each other is described. However, it is also possible to incorporate the memory-communication control board 220 within the printer control unit 204. In accordance with such an arrangement, communication between the printer control unit 204 and memory-communication control board 220 can be made unnecessary. As a result, it is possible to lower the cost of the microcontroller used in the memory communication control unit 220*a* and to eliminate a delay in operation ascribable to communication between the printer control unit 204 and memory communication control unit 220*a*.

The present invention can be applied to a system constituted by a plurality of devices (e.g., a host computer, interface, reader, printer, or other device) or to an apparatus comprising a single device (e.g., a copier or facsimile machine, or another device).

Furthermore, it goes without saying that the object of the invention is attained also by supplying a storage medium (or recording medium) storing the program codes of the software for performing the functions of the foregoing embodiments to a system or an apparatus, reading the program codes with a computer (e.g., a CPU or MPU) of the system or apparatus from the storage medium, and then executing the program codes. In this case, the program codes per se read from the storage medium implement the functions of the above embodiments and the storage medium storing the program codes constitutes the invention. Furthermore, besides the case where the aforesaid functions according to the embodiments are implemented by executing the program codes read by a computer, it goes without saying that the present invention covers a case where an operating system or the like running on the computer performs a part of or the entire process in accordance with the designation of program codes and implements the functions according to the embodiment .

It goes without saying that the present invention further covers a case where, after the program codes read from the storage medium are written in a function expansion card inserted into the computer or in a memory provided in a function expansion unit connected to the computer, a CPU or the like contained in the function expansion card or the function expansion unit performs a part of or the entire process in accordance with the designation of program codes and implements the function of the above embodiment.

The present invention is not limited to the above embodiments and various changes and modifications can be made within the spirit and scope of the present invention.

Therefore, to apprise the public of the scope of the present invention, the following claims are made.

What is claimed is:

1. An image forming apparatus from which a unit, having a non-volatile memory for storing first information indicating that the unit is unused and second information indicating the first date of use of the unit, can be removed, comprising:

update designation means for designating updating of the first or second information stored in the non-volatile memory; and update means for updating the first or second information based upon a designation by said update designation means;

wherein said update means updates the second information after the completion of updating of the first information in a case where said update designation means designates the updating of the first information, and said updates means determines whether or not the second information is to be updated based on the updating of the first information, in a case where said update designation means designates the updating of the second information.

2. The apparatus according to claim 1, wherein said update means updates the second information if the first information has been updated in a case where said update designation means designates the updating of the second information.

3. The apparatus according to claim 2, wherein said update means updates the second information in a case where the second information is a predetermined value.

4. The apparatus according to claim 1, wherein said update means does not update the first information if the first information has not been updated in a case where said update designation means designates the updating of the second information.

5. The apparatus according to claim 1, wherein the second information is updated based on date information supplied from a controller connected to the image forming apparatus.

6. The apparatus according to claim 1, wherein the non-volatile memory is a non-contact communication type of IC memory and exchanges data with a communication circuit in the image forming apparatus.

7. An image forming apparatus for forming an image using a unit which has a non-volatile memory for storing first and second information, the unit being mountable to said image forming apparatus, comprising:

determination means for determining whether the unit has been used or not based on the first information;

first update means for updating the first information in a case where said determination means determines that the unit has not been used;

second update means for updating the second information based on date information after updating the first information in a case where said determination means determines that the unit has not been used; and third update means for updating the second information in a case where said determination means determines that the unit has been used.

8. The apparatus according to claim 7, wherein said second and third update means update the second information in a case where the second information is an initial value.

9. A memory control method in an image forming apparatus from which a unit, having a non-volatile memory for storing first information indicating that the unit is unused and second information indicating the first date of use of the unit, can be removed, comprising:

an update designation step of designating updating of the first or second information stored in the non-volatile memory;

a first update step of updating the second information after the completion of updating of the first information in a case where said update designation step designates the updating of the first information; and a second update step of determining whether the second information is to be updated or not based on the updating of the first information in a case where said update designation step designates updating of the second information, and updating the second information after the completion of the updating of the first information if it is determined that the second information is to be updated.

10. The method according to claim 9, wherein said second update step comprises:

a determination step of determining whether or not the first information has been updated, wherein said second update step updates the second information in a case where said determination step determines that the first information has been updated.

11. The method according to claim 10, wherein said second update step comprises:

a determination step of determining whether or not the first information has been updated, wherein in said second update step, the second information is not updated in a case where said determination step determines that the first information has not been updated.

12. The method according to claim 10, further comprising a step of updating the second information in a case where the second information is a predetermined value, wherein the predetermined value is an initial value of the second information and a value which is not set during normal processing of the image forming apparatus.

13. A memory control method in an image forming apparatus from which a unit having a non-volatile memory for storing first and second information can be removed, comprising:

a determination step of determining whether or not the unit has been used based on the first information;

a first update step of updating the first information in a case where said determination step determines that the unit has not been used in said determination step;

a second update step of updating the second information based on date information after updating the first information in a case where said determination step determines that the unit has been not used; and a third update step of updating the second information in a case where said determination step determines that the unit has been used.

14. The method according to claim 13, wherein the second information is updated at said second and third update steps, in a case where the second information is an initial value.

15. The method according to claim 13, wherein the first information is information indicating that the unit is unused, and the second information is information indicating first date of use of the unit.

* * * * *

UNITED STATES PATENT AND TRADEMARK OFFICE

CERTIFICATE OF CORRECTION

PATENT NO. : 6,708,005 B2
APPLICATION NO. : 10/090148
DATED : March 16, 2006
INVENTOR(S) : Chihara It is certified that error appears in the above-identified patent and that said Letters Patent is hereby corrected as shown below:

COLUMN 6:
Line 57, "e" should be deleted.

COLUMN 9:
Line 52, "in dependent" should read --"independent"--.

COLUMN 10:
Line 44, "means;" should read --means,--.
Line 49, "updates" should read --update--.

Signed and Sealed this

Twenty-second Day of August, 2006

JON W. DUDAS
*Director of the United States Patent and Trademark Office*

UNITED STATES PATENT AND TRADEMARK OFFICE

CERTIFICATE OF CORRECTION

PATENT NO. : 6,708,005 B2
APPLICATION NO. : 10/090148
DATED : March 16, 2004
INVENTOR(S) : Chihara It is certified that error appears in the above-identified patent and that said Letters Patent is hereby corrected as shown below:

COLUMN 6:
Line 57, "e" should be deleted.

COLUMN 9:
Line 52, "in dependent" should read --"independent"--.

COLUMN 10:
Line 44, "means;" should read --means,--.
Line 49, "updates" should read --update--.

This certificate supersedes Certificate of Correction issued August 22, 2006.

Signed and Sealed this

Tenth Day of October, 2006

JON W. DUDAS
*Director of the United States Patent and Trademark Office*